US007422564B2

(12) United States Patent
Parsons et al.

(10) Patent No.: US 7,422,564 B2
(45) Date of Patent: Sep. 9, 2008

(54) TACTILE RHYTHM GENERATOR

(75) Inventors: Christopher V. Parsons, San Antonio, TX (US); David M. Tumey, Crestview, FL (US)

(73) Assignee: Solutions for Thought, LLC, San Antonio, TX (US)

( * ) Notice: Subject to any disclaimer, the term of this patent is extended or adjusted under 35 U.S.C. 154(b) by 150 days.

(21) Appl. No.: 11/138,755

(22) Filed: May 26, 2005

(65) Prior Publication Data

US 2006/0070514 A1 Apr. 6, 2006

Related U.S. Application Data

(63) Continuation-in-part of application No. PCT/US03/23634, filed on Jul. 29, 2003, which is a continuation of application No. 10/306,262, filed on Nov. 27, 2002, now abandoned.

(51) Int. Cl.
*A61H 1/00* (2006.01)

(52) U.S. Cl. ..... 601/46; 601/70

(58) Field of Classification Search ..... 601/46, 601/48, 56, 58, 70
See application file for complete search history.

(56) References Cited

U.S. PATENT DOCUMENTS

| | | | | |
|---|---|---|---|---|
| 1,425,523 | A | | 8/1922 | Hammond, Jr. |
| 3,467,959 | A | | 9/1969 | Zazofsky |
| 3,595,122 | A | | 7/1971 | Brediceanu |
| 3,991,648 | A | | 11/1976 | Karpowicz |
| D249,936 | S | | 10/1978 | Ishida |
| 4,462,297 | A | | 7/1984 | Dill et al. |
| 4,559,929 | A | | 12/1985 | Hseu |
| 4,570,616 | A | | 2/1986 | Kunz et al. |
| 5,054,361 | A | | 10/1991 | Usa |
| 5,471,695 | A | * | 12/1995 | Aiyar ..... 15/22.1 |
| 5,515,764 | A | | 5/1996 | Rosen |
| 5,581,484 | A | | 12/1996 | Prince |
| 5,726,361 | A | * | 3/1998 | Ogawa ..... 73/663 |
| 5,935,089 | A | * | 8/1999 | Shimizu ..... 601/111 |
| 5,959,230 | A | | 9/1999 | Fulford |
| 6,040,517 | A | | 3/2000 | Sakamoto |

(Continued)

FOREIGN PATENT DOCUMENTS

DE 3243428 * 5/1984

(Continued)

OTHER PUBLICATIONS

A DVD video (d. Jul. 29, 2003) of Parsons'classroom test of prototype w/ mixed student population, incl. partially deaf and borderline autistic children.

*Primary Examiner*—Michael A. Brown
(74) *Attorney, Agent, or Firm*—Gunn & Lee, PC; Ted D. Lee

(57) ABSTRACT

A tactile rhythm generator for use by an athlete in training generally includes a signal generator for producing an electrical signal according to a desired timing scheme and a tactile transducer in electrical communication with the signal generator. The tactile transducer, which may take the form of a piezoelectric device, a buzzer, electrodes or any substantial equivalent, is adapted to impart a tactile sensation to the athlete in response to the generated electrical signal. A strap, which may be formed from an elastic material or a soft cloth material with hook and loop fasteners, is provided to secure the tactile transducer in place on the musician's body.

8 Claims, 4 Drawing Sheets

U.S. PATENT DOCUMENTS

| | | | | |
|---|---|---|---|---|
| 6,102,875 | A | 8/2000 | Jones | |
| 6,217,533 | B1 | 4/2001 | McCambridge | |
| 6,432,072 | B1 | 8/2002 | Harris et al. | |
| 6,461,377 | B1 | 10/2002 | Byung-Yul | |
| 6,653,545 | B2 | 11/2003 | Redmann et al. | |
| 6,714,123 | B1 | 3/2004 | Miyake et al. | |
| D488,078 | S | 4/2004 | Nakakjima et al. | |
| 6,737,752 | B2 | 5/2004 | Jameson et al. | |
| 6,774,297 | B1 | 8/2004 | Lee | |
| 6,850,150 | B1 | 2/2005 | Ronkainen | |
| 6,850,782 | B2 | 2/2005 | Bright et al. | |
| 2002/0149561 | A1 | 10/2002 | Fukumoto et al. | |
| 2002/0165921 | A1 | 11/2002 | Sapieyevski | |
| 2003/0003976 | A1 | 1/2003 | Mura | |
| 2003/0024375 | A1 | 2/2003 | Sitrick | |
| 2003/0131416 | A1* | 7/2003 | Lee | 5/652 |
| 2003/0236101 | A1 | 12/2003 | Kemppinen | |
| 2004/0067780 | A1 | 4/2004 | Eiden | |
| 2004/0079220 | A1 | 4/2004 | Yagi | |
| 2004/0099132 | A1 | 5/2004 | Parsons | |
| 2004/0100366 | A1 | 5/2004 | Parsons | |
| 2004/0168565 | A1 | 9/2004 | Nagao et al. | |
| 2004/0255756 | A1 | 12/2004 | Nagakura | |
| 2005/0064912 | A1 | 3/2005 | Yang et al. | |
| 2005/0275508 | A1 | 12/2005 | Orr et al. | |

FOREIGN PATENT DOCUMENTS

| | | |
|---|---|---|
| EP | 1 523 163 | 4/2005 |
| EP | 1 600 907 | 11/2005 |
| JP | 58113779 | 7/1983 |
| JP | 10 248192 | 9/1998 |
| JP | 2001154672 | 6/2001 |
| JP | 2001 259134 | 9/2001 |
| JP | 2002261637 | 9/2002 |
| JP | 2003 145049 | 5/2003 |
| JP | 2004 113944 | 4/2004 |
| JP | 2004205483 | 7/2004 |
| JP | 2004317404 | 11/2004 |
| WO | WO 03/052528 | 6/2003 |
| WO | WO 03/062930 | 7/2003 |
| WO | WO 03/105313 | 12/2003 |

* cited by examiner

TACTILE RHYTHM GENERATOR

RELATED APPLICATIONS

This application claims priority, under 35 U.S.C. § 120 as a continuation-in-part, to P.C.T. international application Ser. No. PCT/US03/23634 filed Jul. 29, 2003 and designating the United States, which is a continuation of U.S. patent application Ser. No. 10/306,262 filed Nov. 27, 2002 now abandoned. By this reference the full disclosures, including the drawings, of P.C.T international application Ser. No. PCT/US03/23634 and U.S. patent application Ser. No. 10/306,262 are incorporated herein as though now set forth in their respective entireties.

FIELD OF THE INVENTION

The present invention relates to methods and apparatus for rhythmic conditioning. More specifically, the present invention relates to a method and apparatus for generating user determinable rhythmic patterns and, thereafter, imparting the patterns to an athlete or medical patient through a tactile transducer.

BACKGROUND OF THE INVENTION

Metronome-like technology has recently been shown to help children with attention problems improve their attention, learning, motor planning and sequencing capabilities. Likewise, metronome-like technology has recently been shown to facilitate athletic training, the technology being useful in helping athletes develop pacing for track and field type events and rhythm for swinging of golf clubs and the like. Unfortunately, the foregoing uses have heretofore relied upon traditional type metronomes, which are limited to providing an audio or visual output signal. As a result, because in many athletic or therapy environments audio cannot be heard and visual attention may not be diverted, the athlete or patient has been required to essentially study a pattern and, thereafter, attempt to mimic the pattern absent direct input from the metronome. Furthermore, in sporting and other venues auditory outputs may be wholly inappropriate due to the distraction caused to others.

It is therefore an overriding object of the present invention to improve over the prior art by providing a programmable metronome with a tactile output that is compact and rugged in implementation such that an athlete or patient may readily wear and utilize the metronome during actual practice for an athletic event or actual conduct of a physical therapy. Additionally, it is an object of the present invention to provide such a tactile metronome that is provided with a compact transducer for easy affixation to an athlete in training. It is a further object of the present invention to provide such a transducer that is highly effective in producing tactile stimulations, such that even an athlete undergoing strenuous physical activity may readily perceive and differentiate tactile stimuli produced by the metronome of the present invention. Still further, it is an object of the present invention to provide such a tactile metronome that is economical to manufacture, easy to use and widely programmable to a variety of complex output rhythms and/or patterns.

SUMMARY OF THE INVENTION

In accordance with the foregoing objects, the present invention-a tactile rhythm Generator-generally comprises a signal generator for producing an electrical signal according to a rhythmic pattern; a tactile transducer in electrical communication with the signal generator, the tactile transducer being adapted to produce tactile stimuli according to the rhythmic pattern; and a fastener associated with the tactile transducer and adapted to securely affix the tactile transducer to a portion of the person's body.

The tactile transducer, which may comprise a piezoelectric device, a buzzer, electrodes, a bone density resonator, an electrical stimulation device, a mechanical transducer, an eccentric motion generator or any substantial equivalent, is adapted to impart a tactile sensation to the person in response to the generated electrical signal. A strap, which may comprise an elastic material or a soft cloth material with hook and loop fasteners, is preferably provided to secure the tactile transducer in place on the person's body.

A programming interface, such as a personal computer or keypad and display combination, is preferably provided for specifying the rhythmic pattern.

In at least one embodiment, the signal generator is adapted to produce complex rhythms and may be programmable such that the user of the tactile rhythm generator may define the complex rhythm. In this embodiment, the signal generator preferably further comprises a micro-controller.

In at least one embodiment of the present invention, a vibrating transducer for producing multiple, readily differentiable tactile stimulations is provided. In the preferred embodiment of the present invention, the vibrating transducer generally comprises a rigid housing; an electric motor enclosed within the rigid housing and having attached thereto an eccentric weight; and wherein the electric motor is supported within the rigid housing by a flexible motor mount. The rigid housing comprises a generally cylindrically shaped tube.

The flexible motor mount may be formed of a cushion, which may be made from foam material or the like. In at least one embodiment of the present invention, the cushion is wrapped substantially about the electric motor, centering the electric motor within the cylindrically shaped tube forming the rigid housing. In order to facilitate manufacture of the vibrating transducer of the present invention, the cushion may be wrapped by a securing sheet such as, for example, a thin paper wrapping, a length of adhesive tape or the like.

In a further embodiment of the vibrating transducer of the present invention, a driver circuit may be provided for facilitating operation of the electric motor. The driver circuit may include a current amplifier.

A display, such as a liquid crystal display or a light emitting diode display, is provided to facilitate selection of the desired output frequency or rhythmic pattern. Likewise, a user interface is provided for input of rhythmic patterns, operational control and the like.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
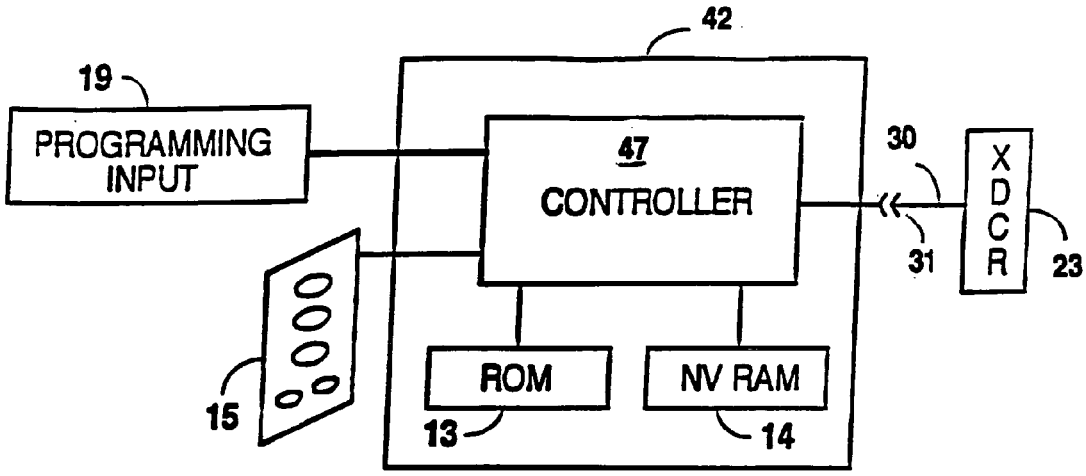
FIG. 1 shows, in a functional block diagram, the preferred embodiment of the tactile rhythm generator of the present invention.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, the tactile rhythm generator 20 of the present invention is shown to generally comprise a signal generator 42 in electrical communication with a tactile transducer 23. As will be better understood further herein, the signal generator 42 is adapted to produce various rhythms and/or complex patterns. The signal generator 42 then communicates a generated rhythm and/or pattern through the tactile transducer 23 to a user. In this manner, as will also be better understood further herein, the tactile rhythm generator 20 may be utilized by a user, such as an athlete 48, to enhance sports acuity and/or accuracy and/or the like. Additionally, the tactile rhythm generator 20 of the present invention may also be utilized for therapeutic purposes such as, for example, assisting patients with neurological, muscular and/or neuromuscular disorders and/or physical injuries in their treatment and/or rehabilitation.

Likewise, the tactile rhythm generator 20 is particularly suited for applications such as speech therapy wherein a user may be required to speak in cadence with a signal source. Traditionally such therapy involves listening for audible tones generated by a signal source and attempting to speak in cadence with the tones while also listening to one's own speech for feedback. Unfortunately, the traditional technique suffers greatly through the overload placed upon the patient's auditory neural pathway. The present invention 20, however, may be utilized to relieve this load by replacing the audible tones with tactile stimuli, thereby freeing the patient's auditory senses for concentration on his or her own speech.

As particularly shown in FIG. 1, the signal generator 42 generally comprises a controller 47 with associated read only memory 13, non-volatile random access memory 14 and various additional implementation components as are readily within the grasp of those of ordinary skill in the art. As will be better understood further herein, the non-volatile random access memory 14 is utilized to store data defining the rhythm or pattern desired for a particular application of the tactile rhythm generator 20. In use, program instruction stored in the read only memory 13 is utilized by the controller 47 to generate an electrical output according to the data stored in the non-volatile random access memory 14. This output, in turn, is utilized by the tactile transducer 23, which may comprise a piezoelectric device, buzzer, set of electrodes or any other substantially equivalent device, to produce a tactile sensation corresponding to the rhythm or pattern.

As also shown in FIG. 1, a programming interface 19 is provided for initially communicating the desired rhythm or pattern to the signal generator 42. In particular, the user utilizes the programming interface 19, which may comprise a desktop or laptop computer, a keypad and display system, a USB port, a wireless interface, a PDA, buttons or dials or any other substantially equivalent system, to input the details of the timing of the desired rhythm or pattern into the non-volatile random access memory 14 of the signal generator 42. Preferably, the programming input 19 interfaces with the signal generator 42 through a bus cable connection, which is only connected during programming of the signal generator 42.

Figure 2:
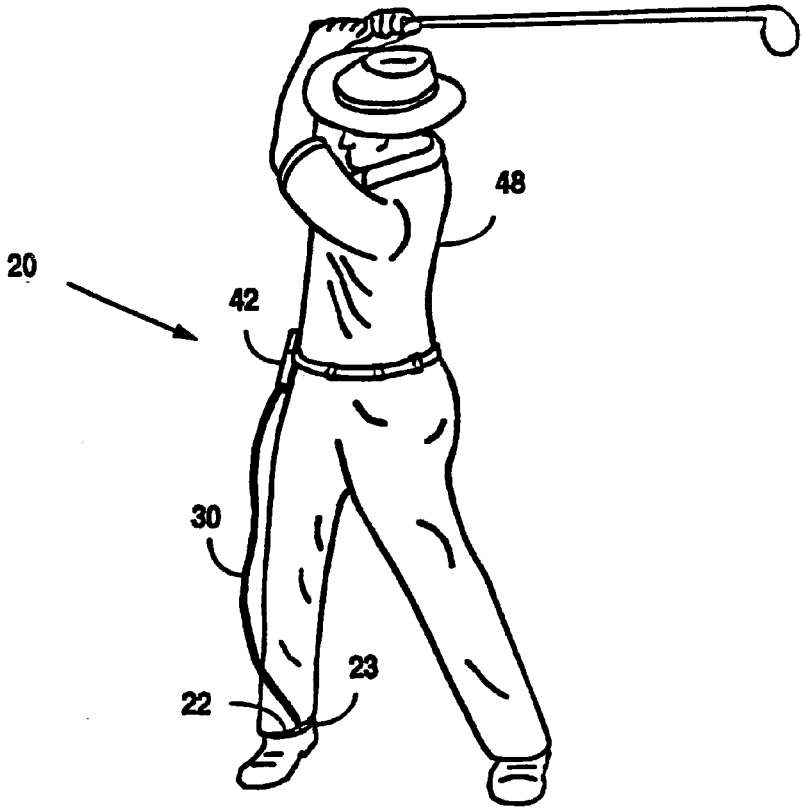
FIG. 2 shows, in a perspective view, one embodiment of the tactile rhythm generator of FIG. 1 as utilized by a golfer in perfection of his golf swing.

In use, an athlete 20 or other user, as depicted in FIG. 2, attaches the tactile transducer 16 to his or her ankle, wrist, chest or other area of the body as dictated by the physical activity in which the user will participate, utilizing an elastic or cloth material strap 17 integrally affixed thereto. The tactile transducer 16 is then electrically connected to the signal generator 42 through an electric cable 18. Control inputs 15 provided on the signal generator 42 are then utilized to commence generation of the desired rhythm or pattern. For example, a golfer may utilize the tactile rhythm generator 20 of the present invention to generate a simple, repeating "one -two" stimulation that the golfer may follow in perfecting his or her swing. Likewise, a high jumper might use a more complex pattern to time his or her accelerating footsteps on approach to the highjump.

Referring now to the FIGS. 3 through 7 in particular, a preferred embodiment of the tactile transducer 23 is shown to comprise a vibrating transducer 24 having the unique ability to produce multiple easily differentiated tactile stimulations. As shown in the figures, such a vibrating transducer 24 generally comprises an electric motor 28 having attached thereto an eccentric weight 33 and encased within a rigid housing 25. As is typical with pager transducers and the like, operation of the electric motor 28 turns a shaft 34 upon which the eccentric weight 33 is mounted with, for example, a pin 35. As will be appreciated by those of ordinary skill in the art, rotation upon the shaft 34 of the eccentric weight 33 produces a vibratory effect upon the motor 28 resulting from the forward portion 32 of the motor 28 attempting to shift laterally outward from the nominal axis 36 of rotation of the shaft 34, as depicted by the centrifugal force lines F in FIG. 6.

In typical implementations of this principle, the electric motor is rigidly fixed to some body such as, for example, a pager or cellular telephone housing with mounting clamps, brackets or the like. In the present implementation, however, unlike the vibrating transducers of the prior art, the electric motor 28 is encased within a rigid housing 25 by the provision of a flexible motor mount 37, which allows the forward portion 32 of the electric motor 28 to generally wobble within the rigid housing 25 as the eccentric weight 33 is rotated upon the motor shaft 34. In this manner, the resultant forces F are the product of much greater momentum in the eccentric weight 33 than that obtained in the fixed configuration of the prior art.

Figure 3:
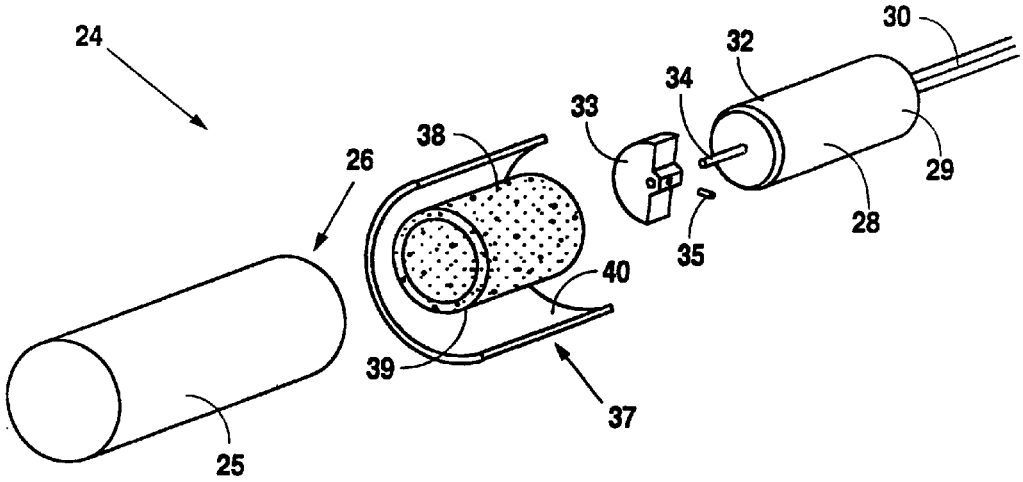
FIG. 3 shows, in an exploded perspective view, the preferred embodiment of a vibrating transducer as has been found to be optimum for use with the tactile rhythm generator of FIG. 2.
Figure 4:
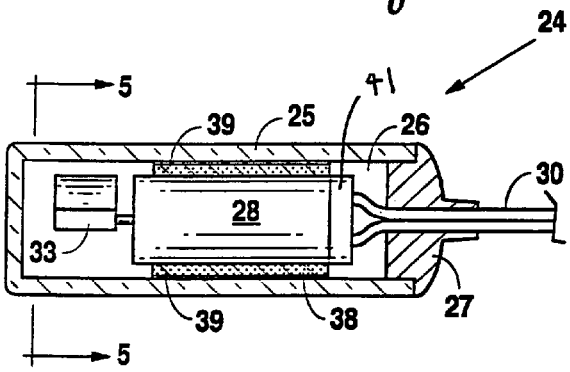
FIG. 4 shows, in a cross sectional side view, details of the arrangement of the internal components of the vibrating transducer of FIG. 3.

In the preferred implementation, as particularly detailed in FIGS. 3 through 6, the flexible motor mount 37 generally comprises a wrapping of preferably foam cushion material 38, which is sized and shaped to snuggly fill the space provided between the electric motor 28 and the interior of the rigid housing 25. To facilitate manufacture of the vibrating transducer 24, as generally depicted in FIG. 3, the foam cushion 38 may be held in place about the body of the electric motor 28 with a cushion securing sheet 40, which may comprise a thin paper glued in place about the cushion 38, thin adhesive tape or any substantially equivalent means. To complete the manufacture of the vibrating transducer 24, the cushioned electric motor 28, with eccentric weight 33 attached to its shaft 34, is inserted into the rigid housing 25 and secured in place by the application of epoxy 27 into the open, rear portion 26 of the housing 25. As will be understood by those of ordinary skill in the art, the epoxy 27 also serves to stabilize the power cord 30 to the electric motor 28, thereby preventing accidental disengagement of the power cord 30 from the electric motor 28.

Figure 5:
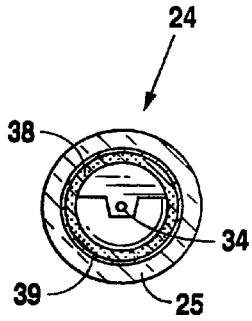
FIG. 5 shows, in a cross sectional end view taken through cut line 5-5 of FIG. 4, additional details of the arrangement of the internal components of the vibrating transducer of FIG. 3.
Figure 6:
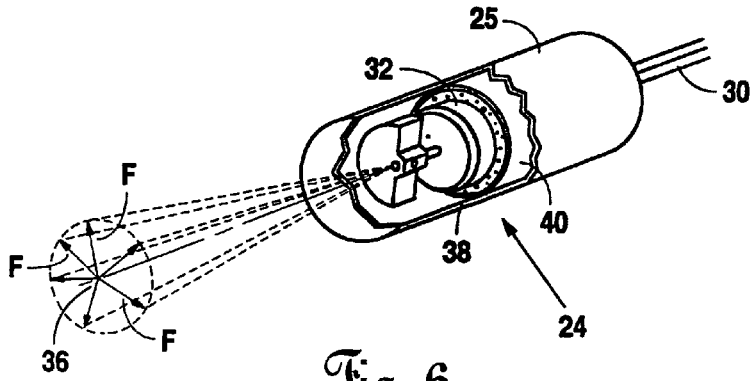
FIG. 6 shows, in a partially cut away perspective view, a representation of the forces produced in the operation of the vibrating transducer of FIG. 3.
Figure 7A:
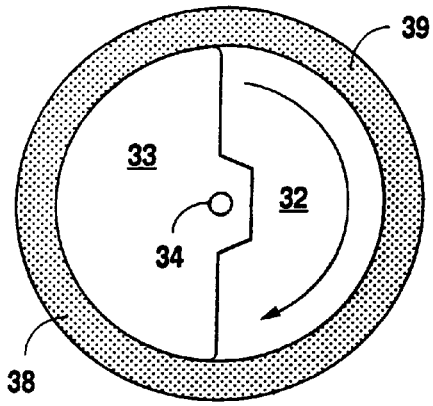
FIGS. 7A through 7F show, in schematic representations generally corresponding to the view of FIG. 5, changes in the relative positions of various internal components of the vibrating transducer of FIG. 3, which changes occur as a result of the operational forces represented in FIG. 6.
Figure 7B:
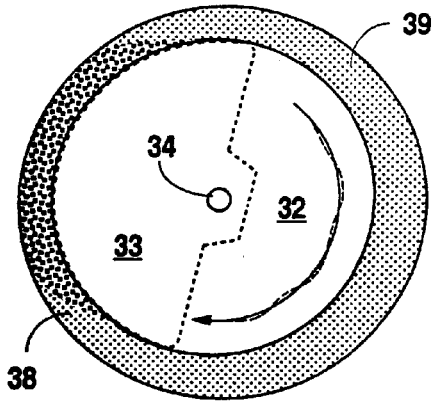
Figure 7C:
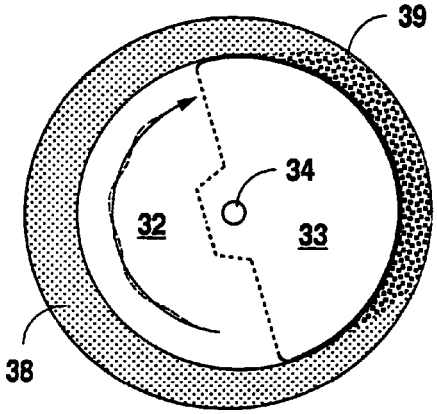
Figure 7D:
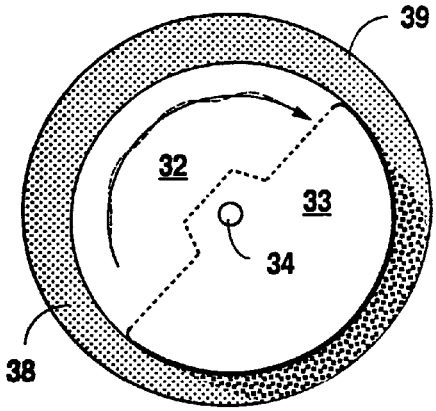
Figure 7E:
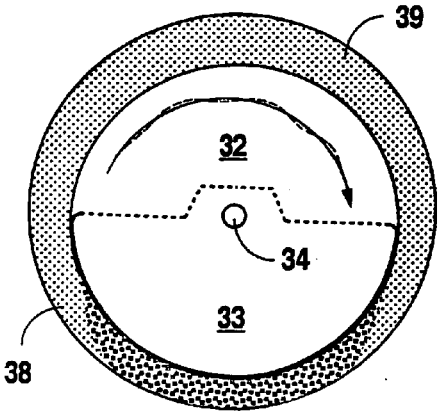
Figure 7F:
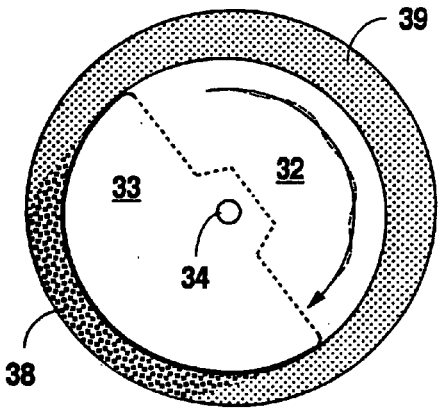

Referring now to FIGS. 5 through 7 in particular, the enhanced operation of the vibrating transducer 24 is detailed. At the outset, however, it is noted that in order to obtain maximum vibratory effect, the rigid housing 25 is provided in a generally cylindrical shape, as will be better understood further herein. In any case, as shown in the cross sectional view of FIG. 5, and corresponding views of FIGS. 7A through 7F, the forward portion 32 of the electric motor 28 is encompassed by the forward portion 39 of the foam cushion 38. At rest, i.e. without the electric motor 28 in operation, the electric motor 28 is substantially uniformly surrounded by the foam cushion 38, as shown in FIG. 7A.

Upon actuation of the electric motor 28, however, the centrifugal forces F generated by the outward throw of the eccentric weight 33 causes the axis of rotation 36 of the motor's shaft 34 to follow a conical pattern, as depicted in FIG. 6. As a result, the forward portion 32 of the electric motor 28 is thrown into the forward portion 39 of the foam cushion 38, depressing the area of cushion adjacent the eccentric weight 33 and allowing expansion of the portion of the cushion generally opposite, as depicted in FIGS. 7B through 7F corresponding to various rotational positions of the eccentric weight 33.

As is evident through reference to FIGS. 7B through 7F, the cooperative arrangement of the cushion 38 about the electric motor 28, as also enhanced by the cylindrical shape of the rigid housing 25, allows the eccentric weight 33 to build greater momentum than possible in embodiments where the motor is rigidly affixed to a body. As the forward portion 39 of the foam cushion 38 compresses under the centrifugal forces F of the eccentric weight 33, however, a point is reached where the foam cushion 38 is no longer compressible against the interior wall of the rigid housing 25 and the forward portion 32 of the electric motor 28 is repelled away from the interior wall toward the opposite portion of interior wall.

The result is a vibratory effect much more pronounced than that obtained in prior art configurations calling for the rigid affixation of an electric motor to a housing. Additionally, Applicant has found that the resulting pronounced vibratory effect is generally more perceptible to the human sense of touch than is that produced by prior art configurations. In particular, small differences on the order of tens of milliseconds or less in duration of operation of the vibrating transducer 20, i.e. duration of powering of the electric motor 28, are easily perceived and differentiated. As a result, this implementation of the vibrating transducer 24 is particularly adapted for implementation of the tactile rhythm generator 20 of the present invention, which preferably comprises provision for distinct tactile stimuli representing particular motions or positions within a motion to be performed by an athlete 48 as well as the generation and communication of complex rhythms, which may require very quickly perceived stimulations with very little pause therebetween.

Figure 8:
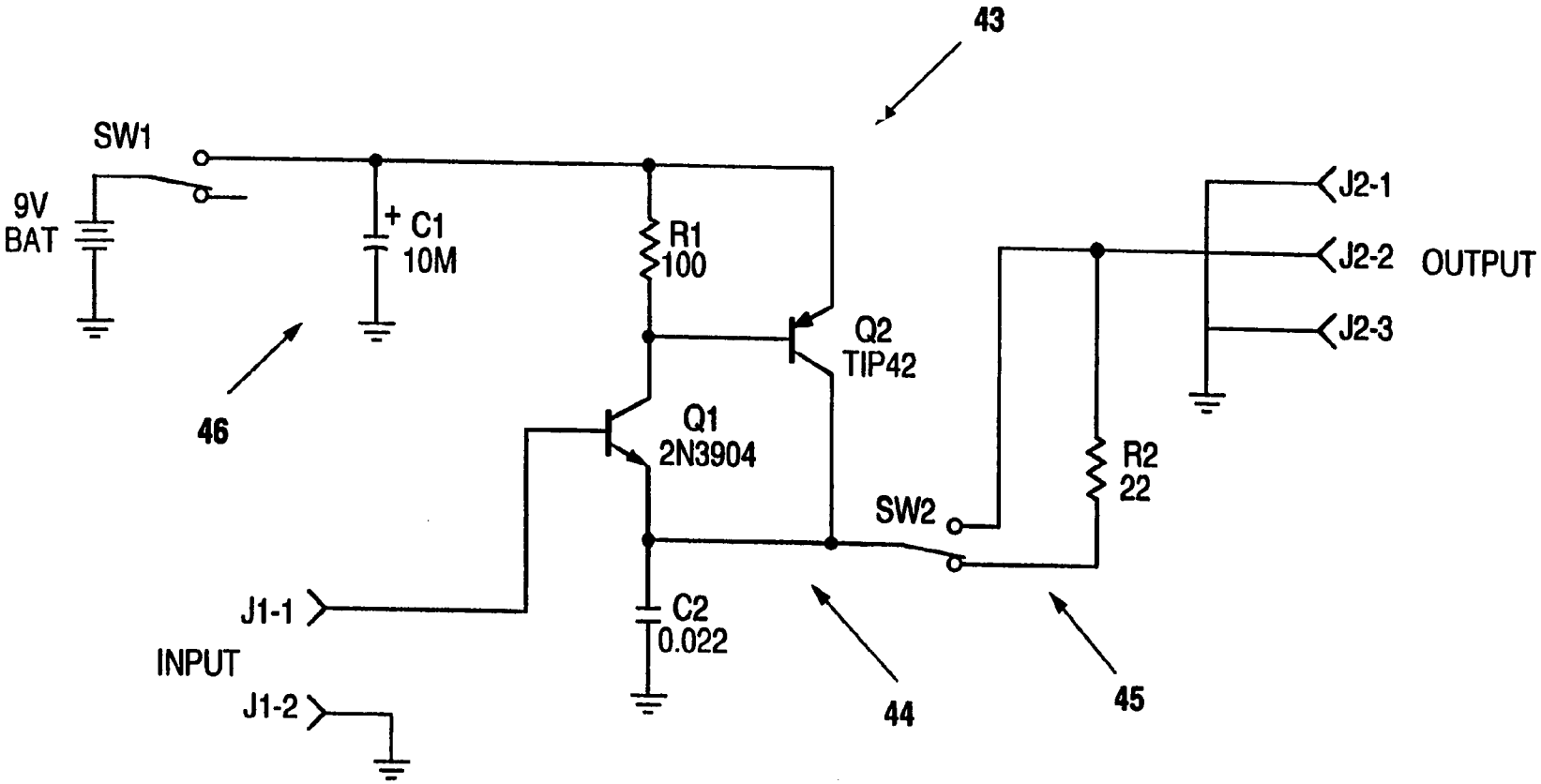
FIG. 8 shows, in a schematic diagram, details of one embodiment of a driver circuit, as depicted in FIG. 2, appropriate for operation of the vibrating transducer of FIG. 3.

As previously discussed, the signal source 41 of the tactile rhythm generator 20 of present invention preferably comprises a driver circuit 43 for interfacing with the tactile transducer 23. In particular, as shown in FIG. 8, such a driver circuit 43 preferably comprises an output amplifier 44, which will generally be required for any implementation in which logical level signals will be expected to drive an electric motor such as is utilized in the preferred implementation of vibrating transducer 24. As will be appreciated by those of ordinary skill in the art, this requirement stems from the fact that such an electric motor 28 will generally have a current requirement beyond the capabilities of most low power solid state components. Additionally, in such implementations, the driver circuit 43 will also require implementation of a power conditioning circuit 46, as also shown in FIG. 8, having the capability to prevent and/or suppress voltage spiking, such as may be expected in response to the highly inductive load typical of the type of electric motor 28 utilized in the implementation of the vibrating transducer 24.

As shown in FIG. 8, an exemplary output amplifier 44, as is appropriate for use with the foregoing described vibrating transducer 24, comprises a 2N3904 NPN BJT transistor Q1, configured as an emitter follower, coupled with a TIP42 high current PNP transistor Q2 in a TO-220 heat dissipating package, for providing the necessary current for operation of the electric motor 28 of the vibrating transducer 24. As will be recognized by those of ordinary skill in the art, the output amplifier 44 as shown may be considered a two stage, high current emitter follower. The power conditioning circuit 46, which is preferably provided to prevent and/or suppress voltage spiking, such as may be expected in response to the highly inductive load typical of the type of electric motor 28 utilized in the implementation of the vibrating transducer 24 may be implemented by tying a 10 μF electrolytic capacitor C1 to ground from the 9-V power bus from, for example, a 9-V battery BAT. As will be recognized by those of ordinary skill in the art, the electrolytic capacitor C1 will temporarily supply additional current to the 9-V bus as may be required to compensate for transients resulting from the draw upon the output amplifier 44 caused during startup of the electric motor 28 of the vibrating transducer 24. Additionally, the power conditioning circuit 46 preferably comprises an ON-OFF switch SW1 and may also include a power on indicator, if desired.

In order to adjust the "feel" of the tactile rhythm generator 20 of the present invention, as previously discussed, the output from the output amplifier 44 is preferably fed through an output power level selector 45 to an outputjack J2, into which the power cord plug 31 of the power cord 30 to the electric motor 28 of the vibrating transducer 24 may be operably inserted. As shown in FIG. 8, the output power level selector 45 preferably comprises a 22 Ω resistor R2, which is selectively placed in series with the output circuit by selecting the appropriate position of a single pole, single throw switch SW2. Although Applicant has found that 22 Ω is an appropriate value for the resistor R2, it is noted that the value is selected empirically in order to obtain the user desired tactile feel for the "low" output selection. Additionally, those of ordinary skill in the art will recognize that the resistor R2 may be replaced with a potentiometer, thereby providing a fully adjustable output power level.

Although the driver circuit 43 has been described as being integral with the signal source 41, it should be appreciated that the present invention contemplates that any necessary driver circuit 43 may be provided as part of the tactile transducer 23. In this manner, the signal source 41 may be utilized with virtually any type of tactile transducer 23, the driver circuit 43 being adapted to provide all necessary electrical compatibility between the chosen tactile transducer 23 and the signal source 41. In such an implementation, the driver circuit 43 should be provided with an input jack J1 for receiving signals from the signal generator 42.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and the claims drawn hereto. For example, those of ordinary skill in the art will recognize, especially in light of his exemplary description, that it may be desirable to integrate the signal generator 11 and the tactile transducer 16 into a single, self-contained device integral with the strap 17. In this manner, the tactile rhythm generator 20 may be compactly and securely affixed to an athlete's wrist, ankle or other location without worry that the generator 20 will inadvertently be dropped or that the athlete 20 will become entangled in electric cables or the like. In any case, because the scope of the present invention is much broader than any particular embodiment, the foregoing detailed description should not be construed as a limitation of the present invention, which is limited only by the claims appended hereto.

What is claimed is:

1. A vibrating transducer apparatus for imparting tactile stimuli to a person according to a rhythmic pattern, the vibrating transducer apparatus comprising:

a portable signal generator that includes an electric motor having an eccentrically mounted weight, adapted to be worn on a belt, for producing an electrical signal according to a rhythmic pattern;

a rigid housing that encloses the portable signal generator;

a flexible motor mount supporting said electric motor within the rigid housing, said motor mounted being adapted to enable said electric motor, when energized, to wobble within said rigid housing, thereby enhancing intensity of vibratory tacticle stimulations produced;

a compressible material encircling said electric motor so that said electric motor, when energized, is adapted to wobble within said rigid housing by compressing said compressible material at different points about the circumference of said electric motor as said eccentrically mounted weight turns;

a wearable tactile transducer in electrical communication with the signal generator, the wearable tactile transducer being adapted to produce tactile stimuli according to the rhythmic pattern, the wearable tactile transducer being structurally isolated from the rigid housing enclosing the portable signal generator so that vibrations from the wearable tactile transducer are not transmitted to, nor diminished by, the rigid housing enclosing the portable signal generator;

an electrical cable connecting the portable signal generator to the wearable tactile transducer; and a fastener for holding the wearable tactile transducer in contact with a person's body.

2. The vibrating transducer apparatus of claim 1, wherein the portable signal generator and wearable tactile transducer are adapted for producing short, discrete pulses, less than one-hundred milliseconds in duration, of vibratory tactile stimulations.

3. The vibrating transducer apparatus of claim 1, wherein the rigid housing comprises a generally cylindrically shaped tube.

4. The vibrating transducer apparatus of claim 3, wherein said compressible material is wrapped by a securing sheet.

5. The vibrating transducer apparatus of claim 1, further comprising a driver circuit in communication with the portable signal generator for facilitating operation of the electric motor.

6. The vibrating transducer apparatus of claim 1, wherein the portable signal generator is adapted to energize the motor according to a programmed rhythm.

7. The vibrating transducer apparatus of claim 1, wherein the fastener is a strap adapted to surround a user's leg.

8. The vibrating transducer apparatus of claim 1, wherein the fastener is a strap adapted to surround a user's leg.

* * * * *